US010597941B2

(12) United States Patent
Moss et al.

(10) Patent No.: US 10,597,941 B2
(45) Date of Patent: Mar. 24, 2020

(54) STEP LADDERS, COMPONENTS FOR STEP LADDERS AND RELATED METHODS

(71) Applicant: Wing Enterprises, Incorporated, Springville, UT (US)

(72) Inventors: N. Ryan Moss, Mapleton, UT (US); Benjamin L. Cook, Provo, UT (US); Sean R. Peterson, Santaquin, UT (US)

(73) Assignee: WING ENTERPRISES, INCORPORATED, Springville, UT (US)

( * ) Notice: Subject to any disclaimer, the term of this patent is extended or adjusted under 35 U.S.C. 154(b) by 0 days.

(21) Appl. No.: 14/496,987

(22) Filed: Sep. 25, 2014

(65) Prior Publication Data

US 2015/0090533 A1 Apr. 2, 2015

Related U.S. Application Data

(60) Provisional application No. 62/045,979, filed on Sep. 4, 2014, provisional application No. 61/883,650, filed on Sep. 27, 2013.

(51) Int. Cl.
*E06C 1/39* (2006.01)
*E06C 1/18* (2006.01)
(Continued)

(52) U.S. Cl.
CPC ..... *E06C 1/18* (2013.01); *E06C 1/16* (2013.01); *E06C 7/14* (2013.01); *E06C 7/46* (2013.01)

(58) Field of Classification Search
CPC ..... E06C 1/39; E06C 1/14; E06C 1/16; E06C 1/18; E06C 1/24; E06C 1/26; E06C 1/28;
(Continued)

(56) References Cited

U.S. PATENT DOCUMENTS 375,482 A * 12/1887 Ethridge ..... E06C 1/383 182/159
763,209 A * 6/1904 Schwalbe ..... E06C 1/387 182/156
(Continued)

FOREIGN PATENT DOCUMENTS

CA 161317 A 3/2016
CA 165519 A 3/2016
(Continued)

OTHER PUBLICATIONS

Design U.S. Appl. No. 29/501,487, filed Sep. 4, 2014.
(Continued)

*Primary Examiner* — Daniel P Cahn
(74) *Attorney, Agent, or Firm* — Dorsey & Whitney LLP

(57) ABSTRACT

A step ladder includes a first assembly having a first pair of spaced apart rails, a second assembly having at least one rail, and a top cap coupled with the first assembly and the second assembly. At least one of the first and second assemblies may be pivotally coupled with the top cap. The first assembly includes a plurality of rungs coupled with the rails and may exhibit a vertical spacing of a first distance between adjacent rungs, a vertical spacing equal to the first distance between the lowermost rung and a supporting surface (e.g., the ground), and a vertical spacing between the uppermost rung and the top cap that is greater than the first distance. In one particular embodiment, the vertical spacing between the uppermost rung and the top cap is twice the distance of the first distance.

12 Claims, 12 Drawing Sheets

(51) Int. Cl.
*E06C 7/46* (2006.01)
*E06C 1/16* (2006.01)
*E06C 7/14* (2006.01)

(58) Field of Classification Search
CPC ... E06C 1/32; E06C 1/387; E06C 1/30; E06C 7/00; E06C 7/16; E06C 7/48; E06C 7/423
See application file for complete search history.

(56) References Cited

U.S. PATENT DOCUMENTS 1,496,558 A * 6/1924 Schulzke ..... E06C 1/16 182/175
1,935,349 A 11/1933 Breslow
1,954,112 A * 4/1934 Winter ..... E06C 1/16 182/125
2,109,886 A * 3/1938 Lewis ..... E06C 1/393 182/124
2,392,527 A 1/1946 Divil
3,861,500 A 1/1975 Dempsey
3,871,481 A * 3/1975 Ballek ..... E06C 1/38 182/151
3,998,293 A * 12/1976 Raia ..... E06C 7/081 182/204
4,011,926 A * 3/1977 Larson ..... E06C 7/42 182/107
4,027,741 A 6/1977 Derrick
4,079,814 A 3/1978 Larson
4,210,224 A 7/1980 Kummerlin et al.
4,332,308 A 6/1982 Larson
4,407,045 A 10/1983 Boothe
D310,884 S 9/1990 Patton et al.
4,979,590 A * 12/1990 Bailey ..... E06C 7/14 182/106
5,107,958 A 4/1992 Johnson
5,158,151 A * 10/1992 Chang ..... E06C 1/18 182/156
D334,240 S * 3/1993 Huffine ..... D25/68
D340,773 S 10/1993 Bartnicki et al.
5,497,850 A 3/1996 Patterson
5,584,357 A * 12/1996 Gugel ..... B25H 3/06 182/129
5,722,507 A 3/1998 Kain
5,791,436 A * 8/1998 Talley, Sr. ..... E06C 1/393 182/116
D422,717 S 4/2000 Bartnicki et al.
6,073,726 A * 6/2000 McCrystal ..... E06C 1/12 182/195
6,095,283 A * 8/2000 Ellis ..... E06C 1/38 182/106
6,206,139 B1 * 3/2001 Bogart, Jr. ..... E06C 1/22 182/166
6,364,057 B1 4/2002 Cornejo et al.
6,401,866 B1 6/2002 Roy
6,450,292 B1 9/2002 Sheffield
6,729,440 B1 5/2004 Bailey
6,779,632 B1 * 8/2004 Parks, III ..... E06C 1/39 182/200
6,874,598 B1 * 4/2005 Baker ..... E06C 1/38 182/165
D520,147 S * 5/2006 Jones ..... D25/68
D530,025 S * 10/2006 Patton ..... D25/68
D531,322 S 10/2006 Patton et al.
D541,433 S 4/2007 Wise
D548,364 S 8/2007 Skubic et al.
D549,356 S * 8/2007 Gibson ..... D25/68
D554,771 S * 11/2007 Skubic ..... D25/64
D576,290 S 9/2008 Meyers et al.
D597,685 S 8/2009 Gibson et al.
7,931,123 B2 4/2011 Moldthan et al.
8,186,481 B2 5/2012 Moss et al.
8,210,313 B2 * 7/2012 Astor ..... E06C 7/14 182/129
8,272,478 B2 * 9/2012 Astor ..... E06C 7/14 182/129
8,365,863 B2 2/2013 Astor
8,365,865 B2 2/2013 Moss et al.
8,376,085 B2 2/2013 Astor et al.
8,453,796 B2 * 6/2013 Astor ..... E06C 7/14 182/119
8,528,696 B2 9/2013 Astor
8,616,336 B2 12/2013 Dangrow et al.
8,701,831 B2 4/2014 Moss et al.
D722,181 S 2/2015 Green
9,527,448 B1 * 12/2016 Kay ..... B60R 3/02
D777,350 S * 1/2017 Moss ..... D25/64
2002/0017430 A1 * 2/2002 Rosko ..... E06C 1/387 182/129
2004/0178018 A1 * 9/2004 Christenson ..... B60R 3/02 182/97
2006/0169535 A1 * 8/2006 Phillips ..... E06C 1/39 182/119
2006/0278474 A1 12/2006 Cumbie
2006/0283664 A1 * 12/2006 Yao ..... E06C 1/125 182/156
2007/0068732 A1 * 3/2007 Nagle ..... E06C 7/08 182/121
2007/0193828 A1 8/2007 Astor et al.
2007/0193829 A1 8/2007 Astor et al.
2008/0029339 A1 * 2/2008 Yewer ..... E06C 1/18 182/104
2010/0116592 A1 * 5/2010 Clements ..... E06C 1/39 182/180.1
2010/0224445 A1 * 9/2010 Moss ..... E06C 1/387 182/129
2011/0024232 A1 * 2/2011 Leng ..... E06C 1/18 182/116
2012/0073903 A1 * 3/2012 Krause ..... E06C 7/146 182/159
2012/0211305 A1 8/2012 Moss et al.
2013/0048427 A1 * 2/2013 Sordo ..... E06C 7/46 182/110
2013/0327593 A1 * 12/2013 Perkins ..... E06C 1/14 182/180.1
2014/0054111 A1 2/2014 Lu
2014/0083888 A1 * 3/2014 Constable ..... E06C 7/14 206/372
2014/0202793 A1 7/2014 Jonas et al.
2014/0332316 A1 * 11/2014 Tiber ..... B26D 7/01 182/129
2015/0090533 A1 4/2015 Moss et al.

FOREIGN PATENT DOCUMENTS

CN 3624010 12/2015
JP 1545330 2/2016
JP 1545335 2/2016

OTHER PUBLICATIONS

Design U.S. Appl. No. 29/501,490, filed Sep. 4, 2014.
Design U.S. Appl. No. 29/501,501, filed Sep. 4, 2014.
Design U.S. Appl. No. 29/501,506, filed Sep. 4, 2014.
U.S. Appl. No. 14/479,035, filed Sep. 5, 2014.
PCT International Search Report for corresponding PCT International Patent Application No. PCT/US2014/057431, dated Jan. 21, 2015.

* cited by examiner

STEP LADDERS, COMPONENTS FOR STEP LADDERS AND RELATED METHODS

CROSS-REFERENCE TO RELATED APPLICATIONS

This application claims benefit to U.S. Provisional Patent Application No. 62/045,979, filed Sep. 4, 2014, and to U.S. Provisional Patent Application No. 61/883,650, filed Sep. 27, 2013, the disclosures of each of which are incorporated by reference herein in their entireties.

BACKGROUND

The present invention relates generally to ladders and, more particularly, to embodiments of stepladders. Ladders are conventionally utilized to provide a user thereof with improved access to elevated locations that might otherwise be inaccessible. Ladders come in many shapes and sizes, such as straight ladders, straight extension ladders, step ladders, and combination step and extension ladders. So-called combination ladders may incorporate, in a single ladder, many of the benefits of multiple ladder designs.

Ladders known as step ladders, also known as A-frame ladders, are self supporting ladders, meaning that they do not need to be leaned against a wall, pole or other structure for stability. Rather, step ladders may be positioned on a floor (or other similar surface) such that at least three, and conventionally four, feet of the ladder provide a stable support structure for a user to climb upon, even in an open space (e.g., outside or in the middle of a room) without a wall, roof, pole or other type of structure being necessary for the stability of the ladder.

In conventional step ladders, the ladder includes a first rail assembly coupled with a top cap and a second rail assembly coupled with the top cap. One of the rail assemblies conventionally include a plurality of rungs that are evenly spaced between the supporting surface (e.g., the floor or ground) and the top cap. As with all ladders, using a step ladder can present various risks to the user. Often, the risks are amplified when a user utilizes the ladder in a non-recommended manner. There is a continuing desire in the industry to provide ladders that reduce the risk of accident and provide improved safety and stability to a user thereof.

SUMMARY

The present invention relates to ladders and, more particularly, various configurations of ladders, as well as to methods relating to the use and manufacture of ladders. In accordance with one embodiment, a step ladder is provided which comprises a first assembly, a second assembly and a top cap coupled with the first and second assemblies. The first assembly comprises a first pair of spaced apart rails and a plurality of rungs extending between and coupled to the first pair of spaced apart rails. The second assembly includes at least one rail. The plurality of rungs of the first assembly exhibit a spacing with a first distance between adjacent rungs and a second distance between the top cap and a rung closest to the top cap, wherein the second distance is at least approximately twice the first distance.

In one embodiment, a lowermost rung of the plurality of rungs exhibits a spacing from a support surface of the ladder that is equal to the first distance.

In one embodiment, the first assembly further comprises a pair of feet, including one foot coupled to each of the first pair of spaced apart rails, wherein the rung closest to the pair of feet exhibits a spacing of the first distance.

In one embodiment, the at least one rail of the second assembly includes a second pair of spaced apart rails.

In one embodiment, the ladder further comprises at least two hinged spreader mechanisms extending between the first assembly and the second assembly.

In one embodiment, at least one of the first assembly and the second assembly is pivotally coupled with the top cap.

In one embodiment, the number of rungs of the plurality of rungs is equal to a nominal height of the ladder in feet minus the integer 2.

In one embodiment, the first distance is approximately 1 foot and the second distance is approximately 2 feet.

In one embodiment, the first assembly and the second assembly are each adjustable in height.

In one embodiment, the first assembly and the second assembly are adjustable in height independent of one another.

In one embodiment, an overall thickness ($T_{TOT}$) of the ladder when in a folded state is less than a sum of a thickness of the pair of rails of the first assembly ($T_{FR}$) and a thickness of the at least one rail of the second assembly ($T_{RR}$). In one particular embodiment, $T_{TOT}$ is approximately equal to $T_{FR}$. In another particular embodiment, $T_{TOT}$ is approximately $1.5 \times T_{FR}$ or less.

In one embodiment, the top cap includes a front wall adjacent the pair of rails of the first assembly, wherein the front wall defines two, spaced apart concave surfaces.

In one embodiment, the rung closest to the top cap exhibits a depth that is greater than the depth of the pair of rails of the first assembly.

In accordance with one embodiment, a step ladder is provided that comprises a first assembly and a second assembly coupled with the first assembly. The first assembly comprises a first pair of spaced apart rails and a plurality of rungs extending between and coupled to the first pair of spaced apart rails. The second assembly includes at least one rail, wherein the at least one rail one rail extends at an acute angle relative to the first pair of rails when the ladder is in a position of intended use. The plurality of rungs exhibit a spacing with a first distance between adjacent rungs and a second distance between an uppermost portion of the step ladder and a rung closest to uppermost portion of the step ladder, wherein the second distance is at least approximately twice the first distance, and wherein the rung closest to the uppermost portion of the step ladder does not contact the second assembly when the ladder is in a deployed state of intended use.

In one embodiment, a lowermost rung, of the plurality of rungs exhibits a spacing from a support surface of the ladder that is equal to the first distance.

In one embodiment, the number of rungs of the plurality of rungs is equal to a nominal height of the ladder in feet minus the integer 2.

In one embodiment, the first distance is approximately 1 foot and the second distance is approximately 2 feet.

In accordance with one embodiment, another step ladder is provided. The step ladder comprises a first assembly, a second assembly and a top cap. The first assembly comprises a first pair of spaced apart rails and a plurality of rungs extending between and coupled to the first pair of spaced apart rails. The second assembly comprises a second pair of spaced apart rails. The first pair of rails are fixedly coupled with the top cap and the second pair of rails are pivotally coupled with the top cap. A lowermost rung of the plurality of rungs is spaced a first distance above a supporting surface when the ladder is in a deployed state of intended use. The plurality of rungs exhibit a vertical spacing between adjacent rungs that is equal to the first distance. An uppermost rung of the plurality of rungs exhibits a vertical spacing from the top cap a second distance which is equal to twice that of the first distance, and wherein the uppermost rung does not contact the second assembly when the ladder is in the deployed state of intended use.

In one embodiment, the first distance is approximately 12 inches.

In one embodiment, an overall thickness ($T_{TOT}$) of the ladder when in a folded state is less than a sum of a thickness of the pair of rails of the first assembly ($T_{FR}$) and a thickness of the at least one rail of the second assembly ($T_{RR}$). In one particular embodiment, $T_{TOT}$ is approximately equal to $T_{FR}$. In another embodiment, $T_{TOT}$ is approximately $1.5 \times T_{FR}$ or less.

In one embodiment, the top cap includes a front wall adjacent the pair of rails of the first assembly, wherein the front wall defines two, spaced apart concave surfaces.

It is noted that the embodiments described herein are not to be considered mutually exclusive of one another and that any feature, aspect or component of one embodiment described herein may be combined with other features, aspects or components of other embodiments.

BRIEF DESCRIPTION OF THE DRAWINGS

The foregoing and other advantages of the invention will become apparent upon reading the following detailed description and upon reference to the drawings in which.

DETAILED DESCRIPTION

Figure 1:
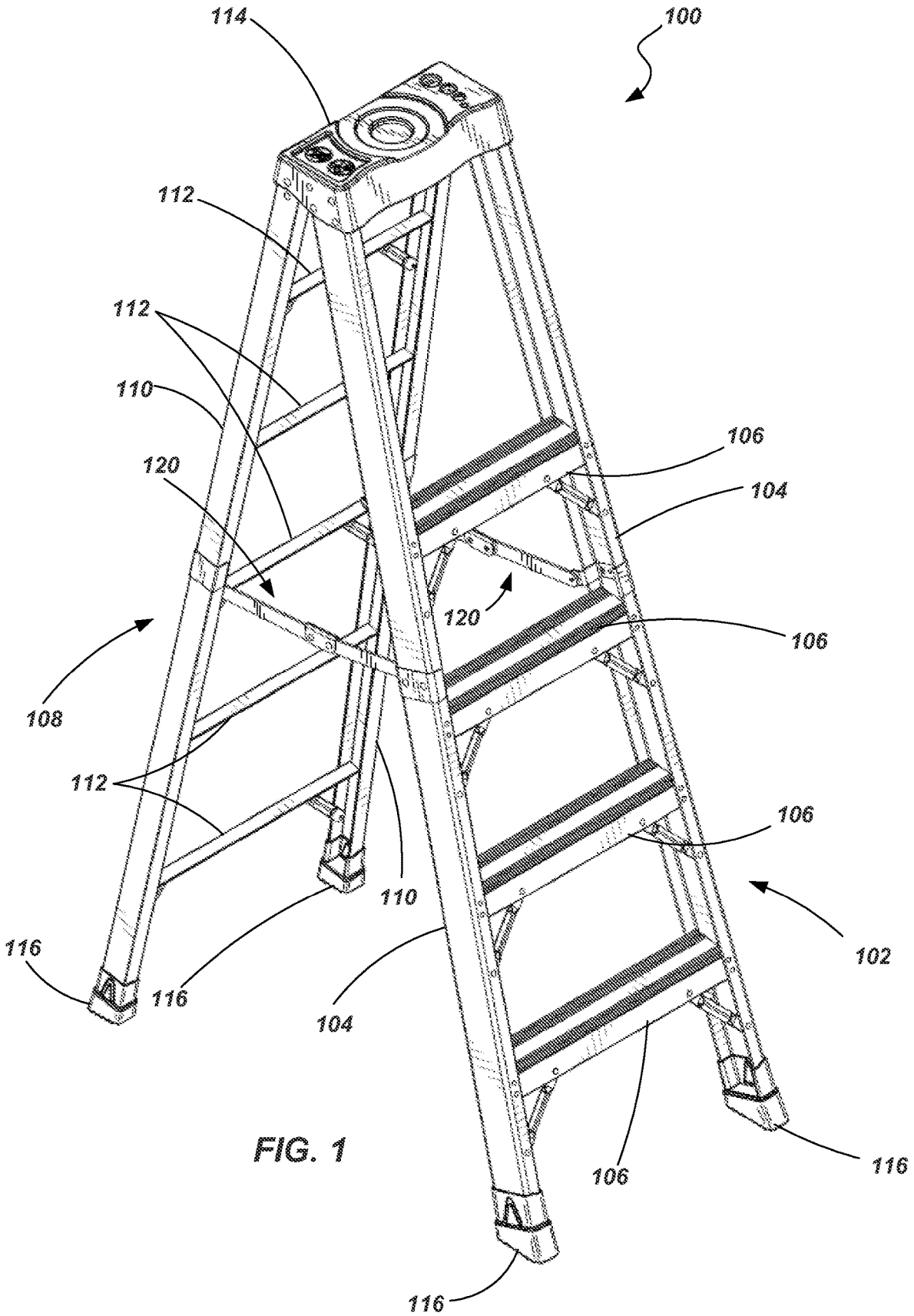
FIG. 1 is a perspective view of a step ladder according to an embodiment of the present invention.

Various embodiments of ladders and ladder components are described herein. The described embodiments are not mutually exclusive of each other. Rather, various features of one described embodiment may be used in conjunction with features of other described embodiments.

Referring to FIGS. 1-5 a stepladder 100 is shown in accordance with an embodiment of the present invention. The stepladder 100 includes a first assembly 102 having a pair of spaced apart rails 104 and a plurality of rungs 106 extending between, and coupled to, the rails 104. The spaced apart rungs 106 are substantially parallel to one another and are configured to be substantially level when the stepladder 100 is in an orientation for intended use so that the rungs 106 may be used as "steps" for a user to ascend the stepladder 100 as will be appreciated by those of ordinary skill in the art. In various embodiments, the upper surface of the rungs 106 may include traction features (e.g., grooves and ridges, grip tape or other anti-slip features) to provide a traction to a user while standing on the rungs 106.

The stepladder 100 also includes a second assembly 108 having a pair of spaced apart rails 110. In the embodiment shown, a plurality of cross-braces 112 extend between, and are coupled to, the spaced apart rails 110. The cross-braces 112 provide a desired level of strength and rigidity to the second assembly 108, but they are not configured as rungs (i.e., they are not intended to support a user). Thus, the second assembly 108 shown in FIGS. 1-5 does not include a plurality of rungs between the spaced apart rails 110. However, in some embodiments, the second assembly 108 may include rungs configured generally similar to those associated with the first assembly 102. The second assembly 108 is used to help support the stepladder 100 when spaced apart from the first assembly 102 and when the ladder 100 is in an intended operational state, such as depicted in FIGS. 1-5. Additionally, while not specifically numbered in the drawings, it is noted that the ladder may include various bracing and support members (e.g., between rails and rungs) to help provide desired strength and stability.

The first and second assemblies 102 and 108 may be formed of a variety of materials and using a variety of manufacturing techniques. For example, in one embodiment, the rails 104 and 110 may be formed of a composite material, such as fiberglass, while the rungs and other structural components may be formed of aluminum or an aluminum alloy. In other embodiments, the assemblies 102 and 108 (and their various components) may be formed of other materials including other composites, plastics, polymers, metals and metal alloys.

A top cap 114 is coupled to a portion of the first assembly 102 and a portion of the second assembly. For example, the top cap 114 may be pivotally coupled to an upper end of each rail 110 of the second assembly 108 along a common axis. In one embodiment, the top cap 114 may simply be a structural component configured to facilitate relative coupling of the first and second assemblies 102 and 108. In other embodiments, the top cap 114 may include features that enable it to be used as a tray or a tool holder. Thus, the top cap 114 may be used to organize a user's tools and resources while working on the stepladder 100. For example, such a top cap is described in U.S. Pat. No. 8,186,481 issued May 29, 2012 and entitled LADDERS, LADDER COMPONENTS AND RELATED METHODS, the disclosure of which is incorporated by reference herein in its entirety. The top cap 114 shown in FIGS. 1-5 will be described in further detail below in accordance with one embodiment of the invention. It is noted that, for safety purposes, the top cap 114 is not conventionally configured as a "rung" or a "step" and is not intended to support a user's standing weight.

As with other components of the stepladder 100, the top cap 114 may be formed from a variety of materials. In one embodiment, the top cap 114 may be formed from a plastic material that is molded into a desired size and shape. Of course other materials and manufacturing processes are also contemplated.

The step ladder 100 may additionally include a plurality of feet 116 (one associated with each rail) configured to engage a supporting surface such as the ground. The feet 116 may be configured in a variety of manners based on, for example, the type of environment in which the ladder is anticipated to be used. For example, the feet 116 may be formed of a plastic or polymer material and be configured with a plurality of ridges, knobs or other engagement features configured to provide increased friction between the ladder and a relatively rigid supporting surface (e.g., concrete, tile or wood). Additionally, or alternatively, the feet 116 may include features such as barbs or other sharp protrusions configured to dig into a relatively softer supporting surface (e.g., dirt or grass).

A pair of hinged braces, referred to herein as spreaders 120, are used to maintain a desired angle between the first and second assemblies 102 and 108 when the stepladder 100 is in a deployed or useable state. The hinged nature of such spreaders 120 helps to enable the first and second assemblies 102 and 108 to collapse into a stored state and then help lock the assemblies 102 and 108 in position relative to one another when in a deployed or useable state. It is noted that the spreaders 120 are not configured as rungs or platforms, or otherwise configured to support a user standing thereon. Rather, the spreaders 120 are simply configured to structurally maintain the ladder 100 in a deployed position while enabling the rail assemblies 102 and 108 to be selectively collapsed relative to each other for storage and transportation of the ladder 100.

The rungs 106 of the ladder 100 are configured in a specific manner to minimize potential safety risks to a user of the ladder 100. Using the example of a six foot ladder (i.e., a step ladder having a nominal height of six feet as measured from the feet 116 to the top cap 114 when in a deployed state), four rungs 106 may be provided and spaced relative to one another at a first distance, while the uppermost rung is spaced from the top cap 114 a second distance that is substantially greater than the first distance. In one particular example, the lowermost rung 106 is positioned such that its upper surface is approximately 1 foot from the supporting surface (e.g., the ground), each of the rungs 106 are space approximately 1 foot apart (e.g., from the upper surface of one rung to the upper surface of an adjacent rung), while the upper surface of the uppermost rung is spaced approximately 2 feet from the upper surface of the top cap 114. Thus, there is a substantial space between the uppermost rung 106 and the top cap 114, discouraging and inhibiting a user from climbing on the top cap 114.

Conventional step ladders include an additional rung that would be positioned evenly between the uppermost rung 106 and the top cap 114 of the ladder shown in FIGS. 1-5. In such conventional ladders, warnings are repeatedly made to users to not stand on such a rung. These warnings may include stickers with statements of potential danger, they may include the rung being formed of a different color (e.g., red or orange) to attract the attention of the user and alert them to the danger of standing on that particular rung. However, such warnings are repeatedly ignored by users. Moreover, oftentimes a user will ascend beyond such a rung and even stand on the top cap of the ladder which is not necessarily configured to structurally support the weight of a user. Thus, the spacing of the rungs 106 shown in the ladder 100 in FIGS. 1-5 prevent a user from standing on the ladder above a prescribed elevation by eliminating the enticement of a rung that exists above that prescribed elevation.

It is noted that the uppermost rung of the step ladder 100 shown in FIGS. 1-5 is not configured as a spreader mechanism and does not engage the second assembly 108. Rather the upper most rung, like the other rungs of the ladder 100, are only directly coupled to the rails 104 of the first assembly 102 and is wholly supported by the first assembly 102.

Figure 2:
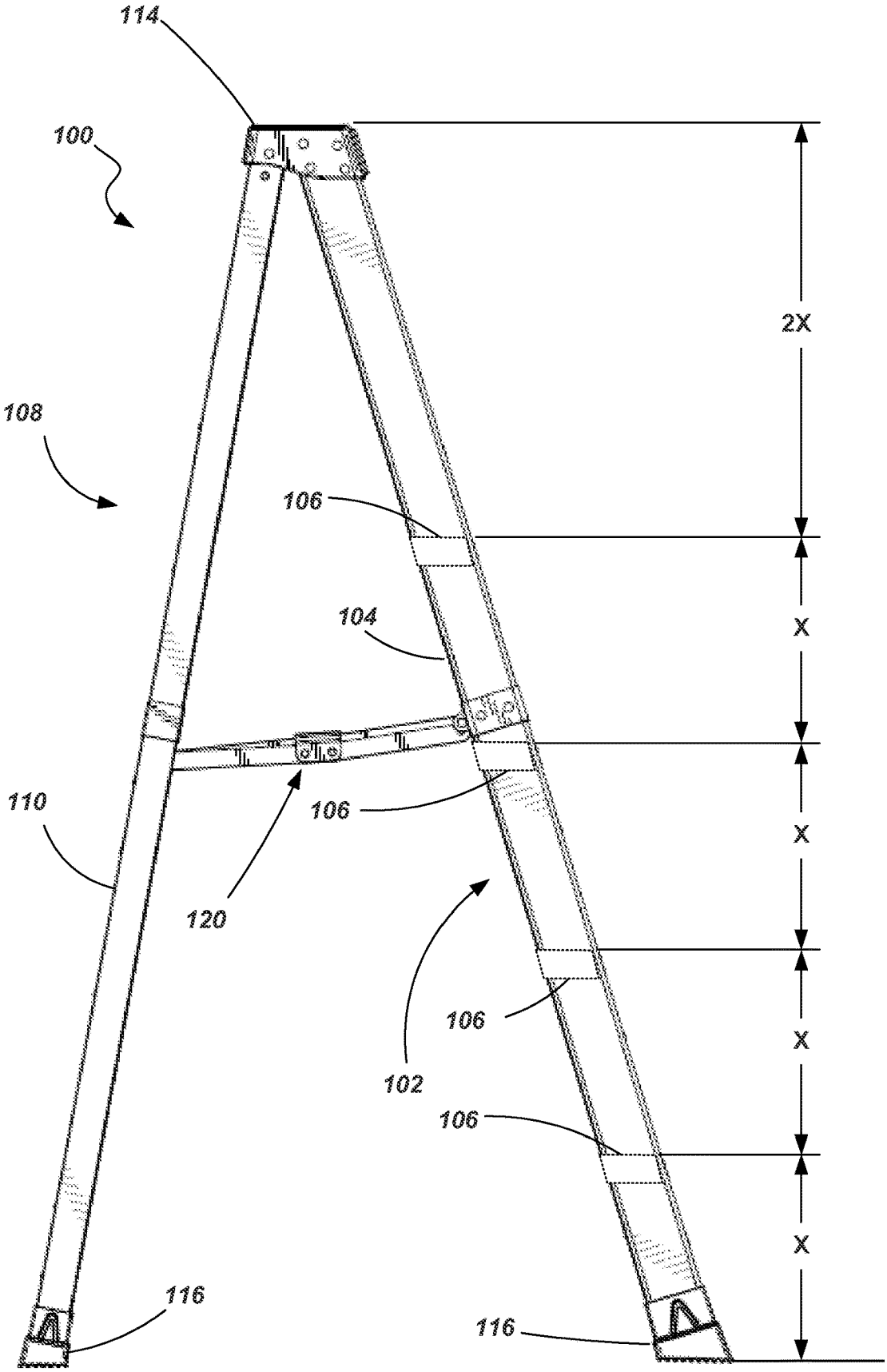
FIG. 2 is a side view of the step ladder shown in FIG. 1.
Figure 3:
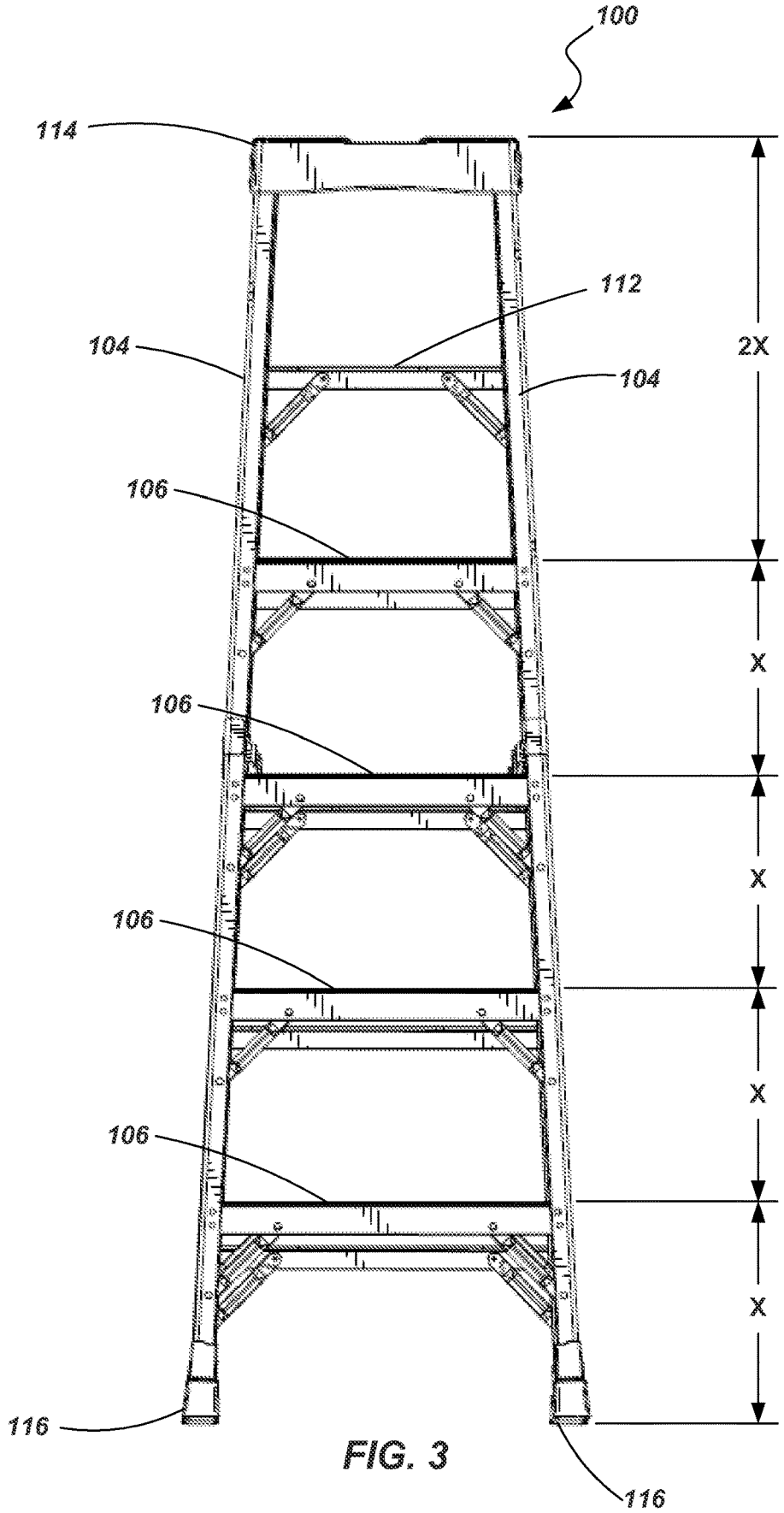
FIGS. 3-5 are front, rear and top views, respectively, of the step ladder shown in FIG. 1.
Figure 4:
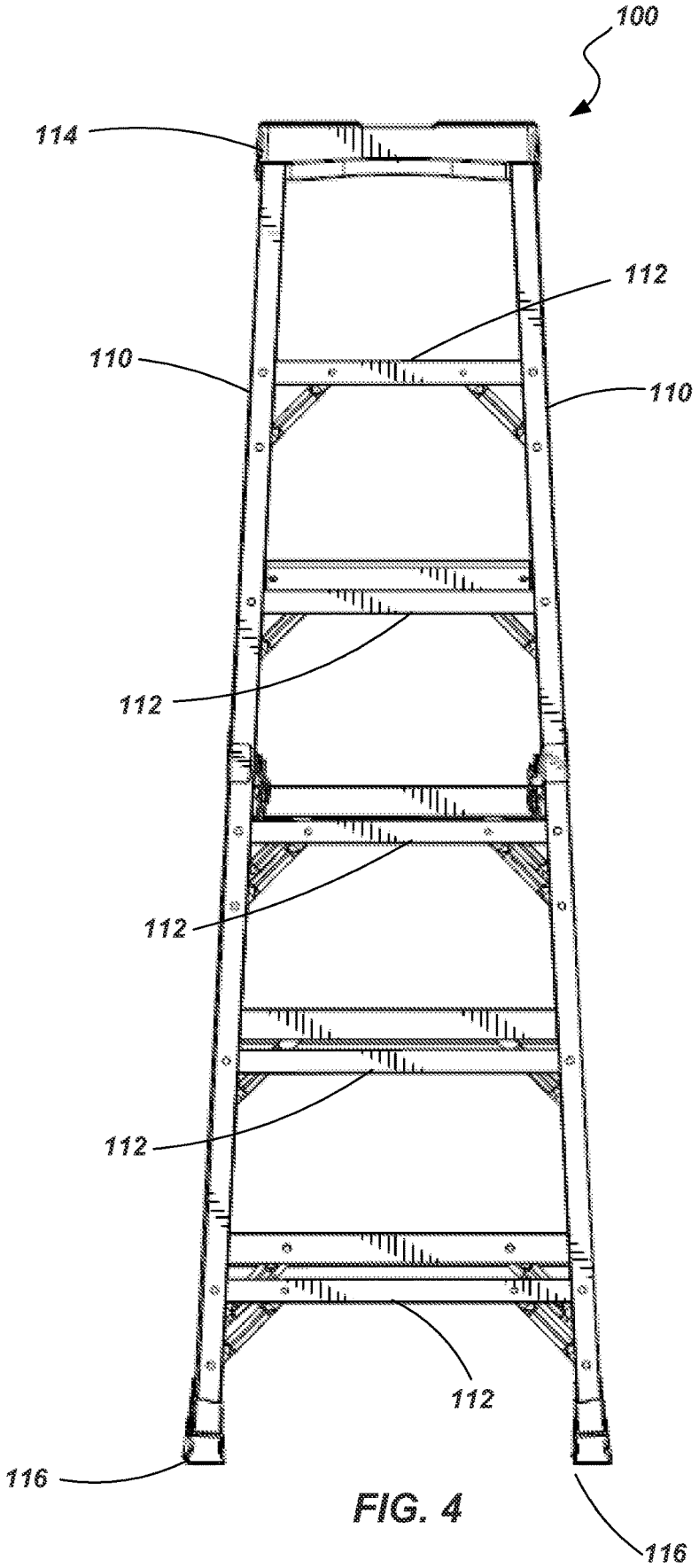
Figure 5:
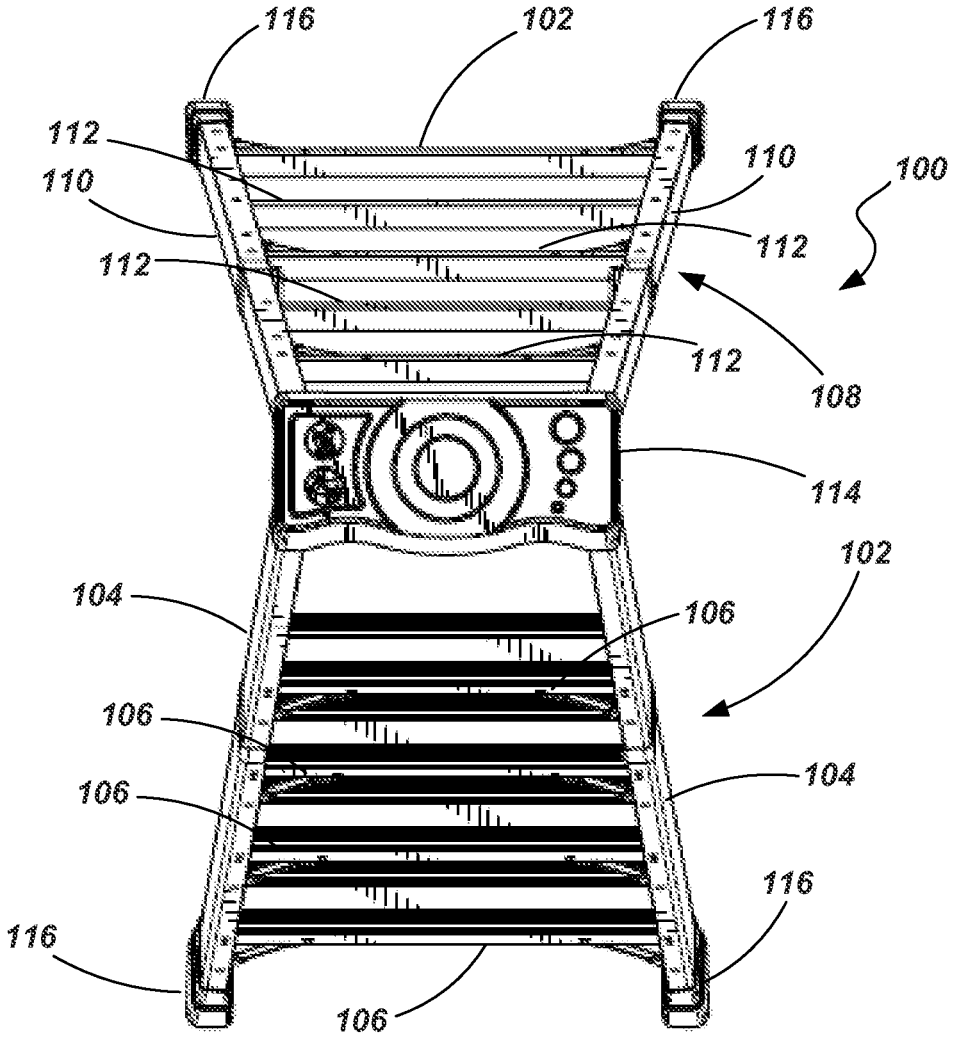

With continued reference to FIGS. 1-5, but with particular reference to FIG. 2 (which shows the rungs 106 in dashed lines for clarity, although the rungs would typically be hidden from view by the rail 104 in this particular view), the spacing of the rungs 106 may be described as each rung 106 being spaced a distance X from an adjacent rung (as measured vertically from upper surface of one rung to the upper surface of the adjacent rung when the ladder is in its deployed and intended orientation), the upper surface of the lowermost rung being spaced a distance X from the supporting surface, and the uppermost rung being spaced a distance 2X (or twice the distance of X) from the top cap 114. Thus, in the embodiment shown in FIGS. 1-5, the ladder 100 is represented as a six foot step ladder, where X is equal to approximately 1 foot (approximately 12 inches). In other words, the vertical spacing between the support surface and the upper surface of the lowermost rung is approximately 12 inches, the vertical spacing between the upper surfaces of adjacent rungs is approximately 12 inches, and the vertical spacing between the upper surface of the uppermost rung and the upper surface of the top cap is approximately 24 inches.

Thus, in one embodiment, the ladder may be described as having a spacing between the upper most rung and the top cap which is twice the distance exhibited between any two adjacent rungs. In another embodiment, the ladder may be described as having a number of rungs R which is equal to a nominal height H minus 2 (e.g., R=H−2). Thus, for example, in such an embodiment, a 4 foot ladder would have 2 rungs, a 6 foot ladder would have 4 rungs and an 8 foot ladder would have 6 rungs. In another embodiment, a step ladder may be configured so that there is a vertical distance of at least two feet between the upper most rung and the top cap. Again, in such embodiments, the uppermost rung is not configured as a spreader member or as a platform that engages the second assembly, but is only directly coupled with the rails of the one rail assembly (e.g., the first assembly).

As noted above, in some embodiments the ladder may be configured with rungs on both the first assembly and the second assembly. In such an embodiment, the rung spacing of each assembly may be similar, with the uppermost rung being spaced relative to the top cap in a manner such as described above.

It is noted that some prior art ladders have had spacing (which is approved by the American National Standards Institute) that includes a vertical spacing between the support surface (e.g., ground) and the upper surface of the lowermost rung of 6 inches, a vertical spacing between upper surfaces of adjacent rungs of 12 inches, and a vertical spacing between the upper surface of the upper most rung and the top cap of 18 inches (to make up for the short step on to the lowermost rung). However, such a configuration provides a number of concerns, including an awkward transition to the first rung (shorter than anticipated) and a different step height from the first rung to the second rung than a user experiences in going from the ground to the first rung (or vice versa). Additionally, while 18 inches of vertical spacing between the uppermost rung and the top cap is increased over the spacing between adjacent rungs (12 inches), such a distance is not likely to discourage a user from stepping up to the top cap from the uppermost rung. Thus, such a ladder is likely to be awkward in use and may pose some hazards to the user.

Figure 6:
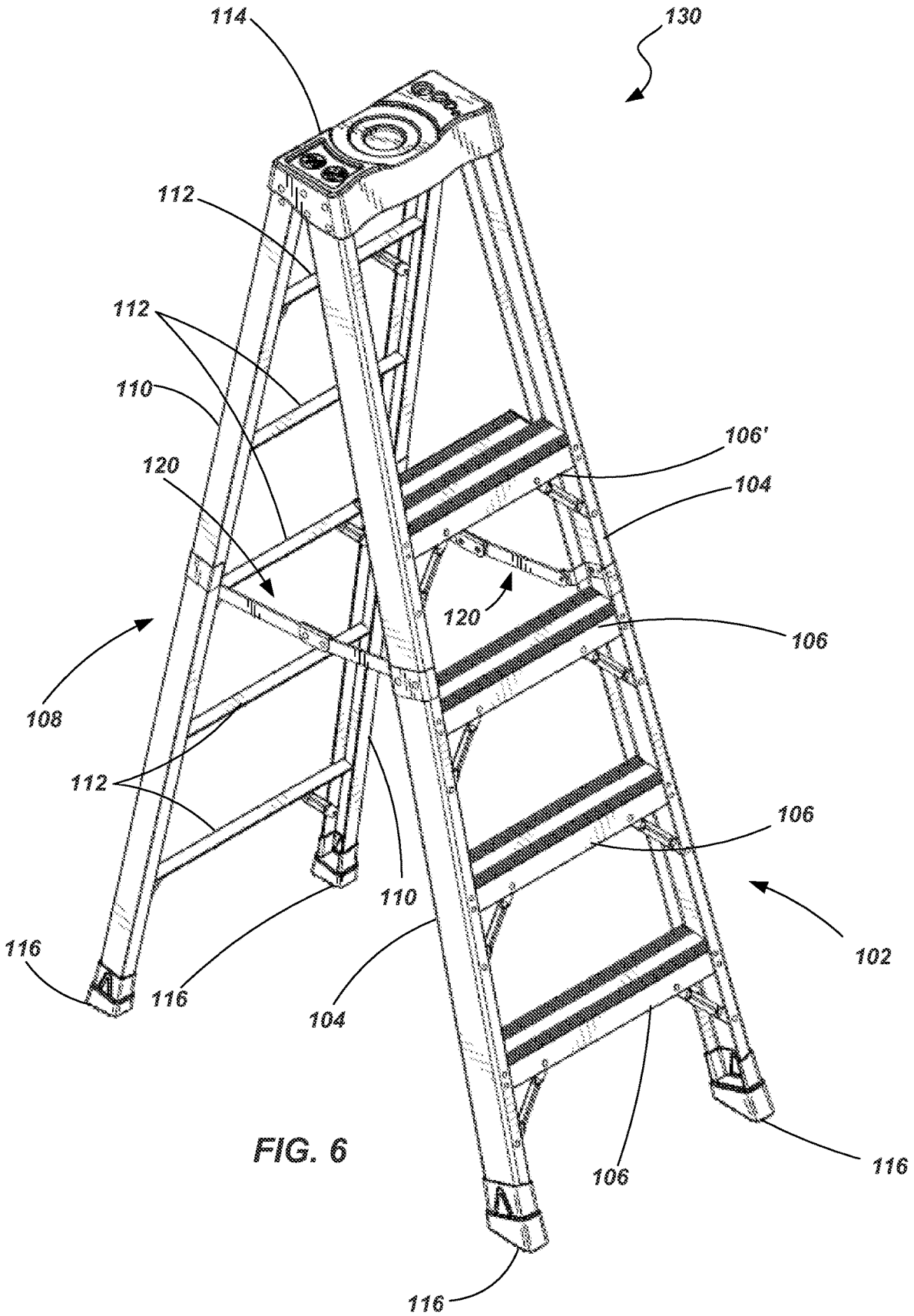
FIGS. 6 and 7 are perspective and side views, respectively, of a step ladder according to an embodiment of the present invention.
Figure 7:
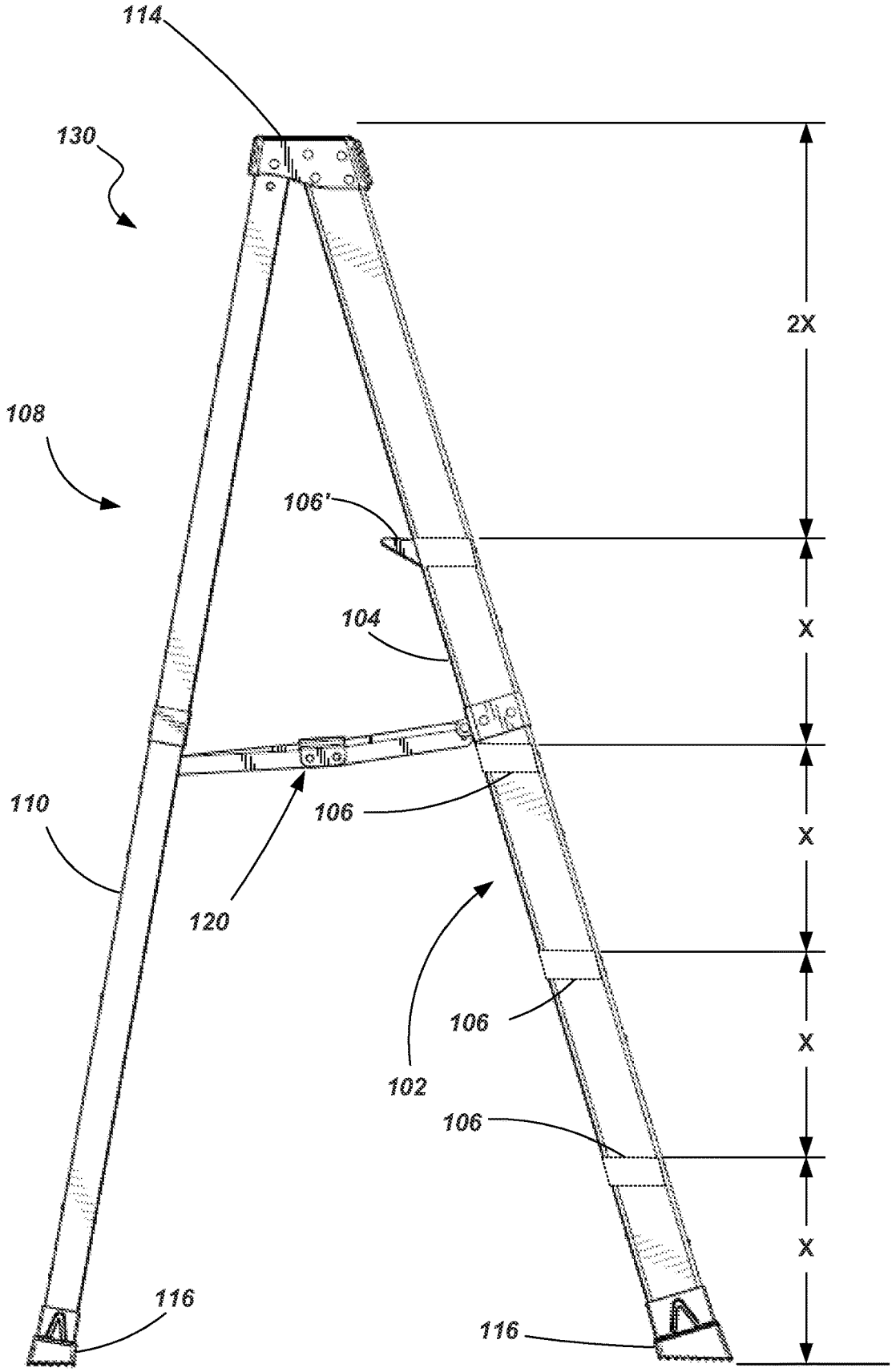

Referring now to FIGS. 6 and 7, a step ladder 130 is shown in accordance with another embodiment of the present invention. The ladder 130 is configured substantially similarly to the ladder 100 described above with respect to FIG. 1, including a first assembly 102, a second assembly 108, a top cap 114 and spreaders 120. The uppermost rung 106' of the ladder 130 exhibits extended depth and includes a portion that extends beyond the back surface of the rails 104 towards the second assembly 108. The extended depth of the uppermost rung 106' provides an enlarged surface for a user to stand on, which may reduce fatigue and provide enhanced comfort to a user who may have to stand on the ladder 130 for an extended period of time. It is noted, however, that even with the extended depth, the uppermost rung 106' is not coupled to or directly supported by any components of the second assembly 108 or the spreaders 120. Rather, the rung 106' is only directly coupled to the rails 104 of the first assembly 102 (and optionally some bracing or reinforcing structures coupled directly between the rung 106' and the rails 104).

Referring to FIGS. 8A-8F, various views of a top cap 114 are shown in accordance with an embodiment of the present invention. As previously noted, the top cap 114 may include a number of features for storing or holding tools or supplies while a user is working on the ladder. For example, a plurality of concentric recesses 140A-140C may be formed in the top cap 114 for positioning or holding containers of various sizes (e.g., paint cans having a size of a gallon, a quart or a pint). Additionally, a recessed area 142 may be formed to hold supplies (e.g., screws or nails), tools or other components. A plurality of openings 144A-144D may also be formed in the top cap 114 for holding various tools (e.g., screwdrivers, hammers, wrenches, pliers, paint brushes, etc.) or other components.

Figure 8B:
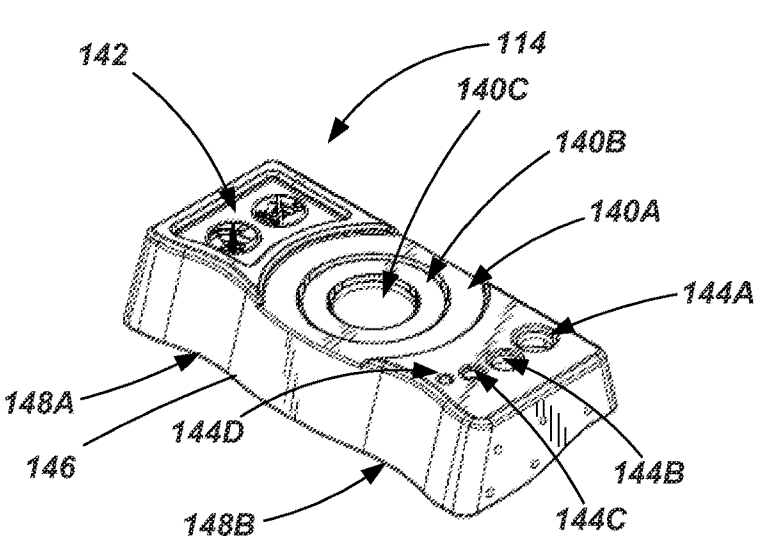
FIGS. 8A-8F are top, perspective, left side, front, right side and rear views, respectively, of a top cap according to an embodiment of the present invention.
Figure 8A:
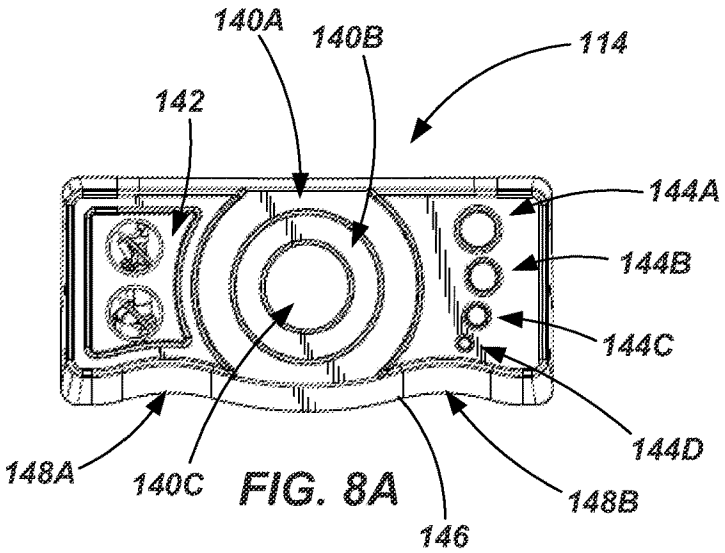
Figure 8F:
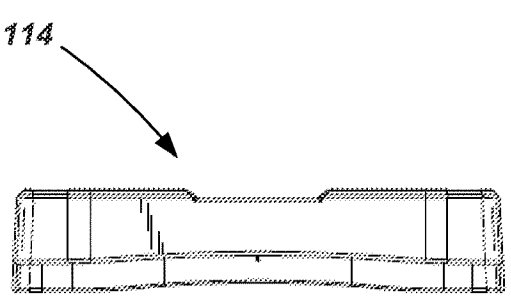
Figure 8E:
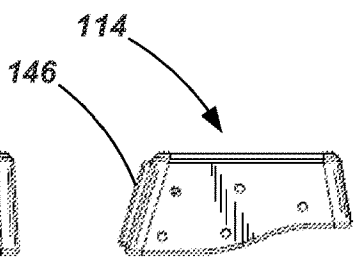
Figure 8D:
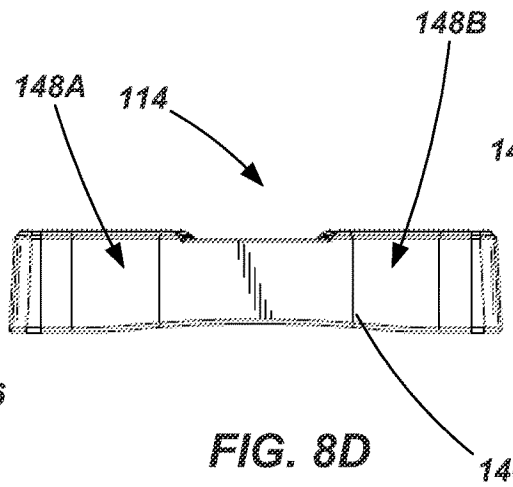
Figure 8C:
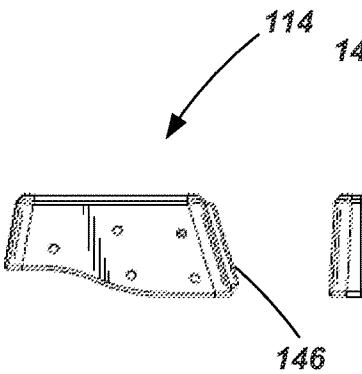

On the front wall 146 of the top cap 114 (i.e., the portion which corresponds with the first assembly 102 of the ladder(s) 100, 130) is configured with a generally undulating surface, including two, spaced apart concave surfaces 148A and 148B and may be best seen in FIGS. 8A and 8B. These two concave surfaces 148A and 148B may be shaped, sized and positioned so that a user's legs may be positioned against the concave surfaces 148A and 148B when they are standing on the upper most rung of the ladder, providing an ergonomic support surface for the user's legs. Depending on the height of the user and the actual spacing between the upper most rung and the top cap (e.g., the vertical distance of "2X"), the user's shins, knees or thighs may rest or lean against the concave surfaces 148A and 148B. Of course other configurations of top caps may be used in association with the ladders described herein.

Figure 9:
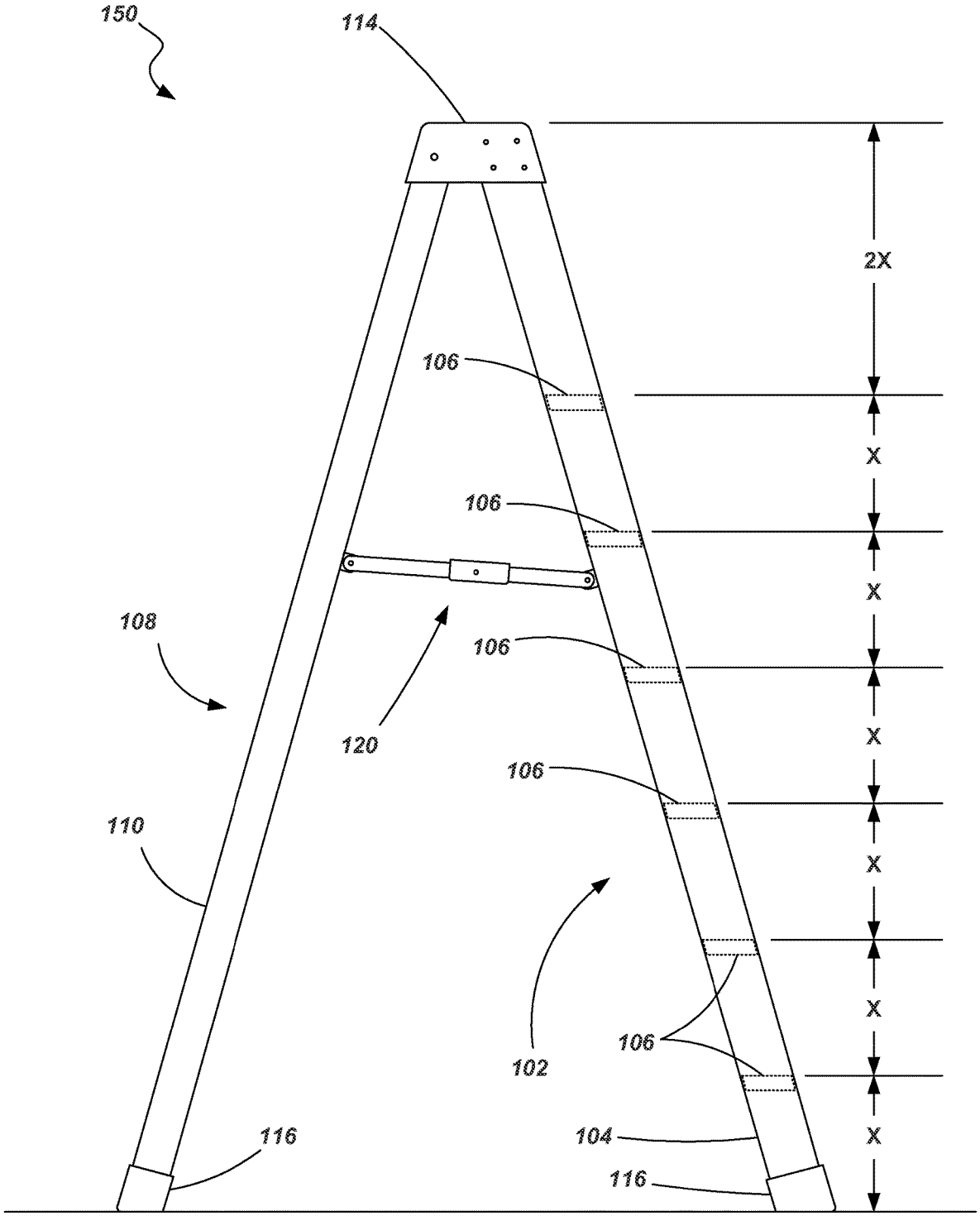
FIG. 9 is a side view of a step ladder in accordance with an embodiment of the present invention.

Referring briefly to FIG. 9, a step ladder 150 is shown in accordance with another embodiment. The ladder 150 is configured substantially similarly to the ladder 100 described above with respect to FIG. 1, including a first assembly 102, a second assembly 108, a top cap 114 and spreaders 120. The step ladder 150 exhibits a different number of rungs 106 than the embodiments described above. In this embodiment, the step ladder 150 includes six different rungs 106 spaced evenly apart (e.g., a vertical spacing of "X") with the uppermost rung being spaced a greater distance (e.g., a vertical spacing of "2X") from the top cap. Using an example of an 8 foot ladder (i.e., a step ladder having a nominal height of 8 feet from the feet 116 to the top cap 114 when in an deployed state), the lowermost rung 106 may be positioned such that its upper surface is approximately 1 foot from the supporting surface, each of the rungs 106 are space approximately 1 foot apart (e.g., from the upper surface of one rung to the upper surface of an adjacent rung), while the uppermost rung is spaced approximately 2 feet from the top cap (e.g., from the upper surface of the uppermost rung to the upper surface of the top cap 114). Thus, the rung spacing described herein may be used in ladders exhibiting a variety of heights and having different numbers of rungs.

Figure 10:
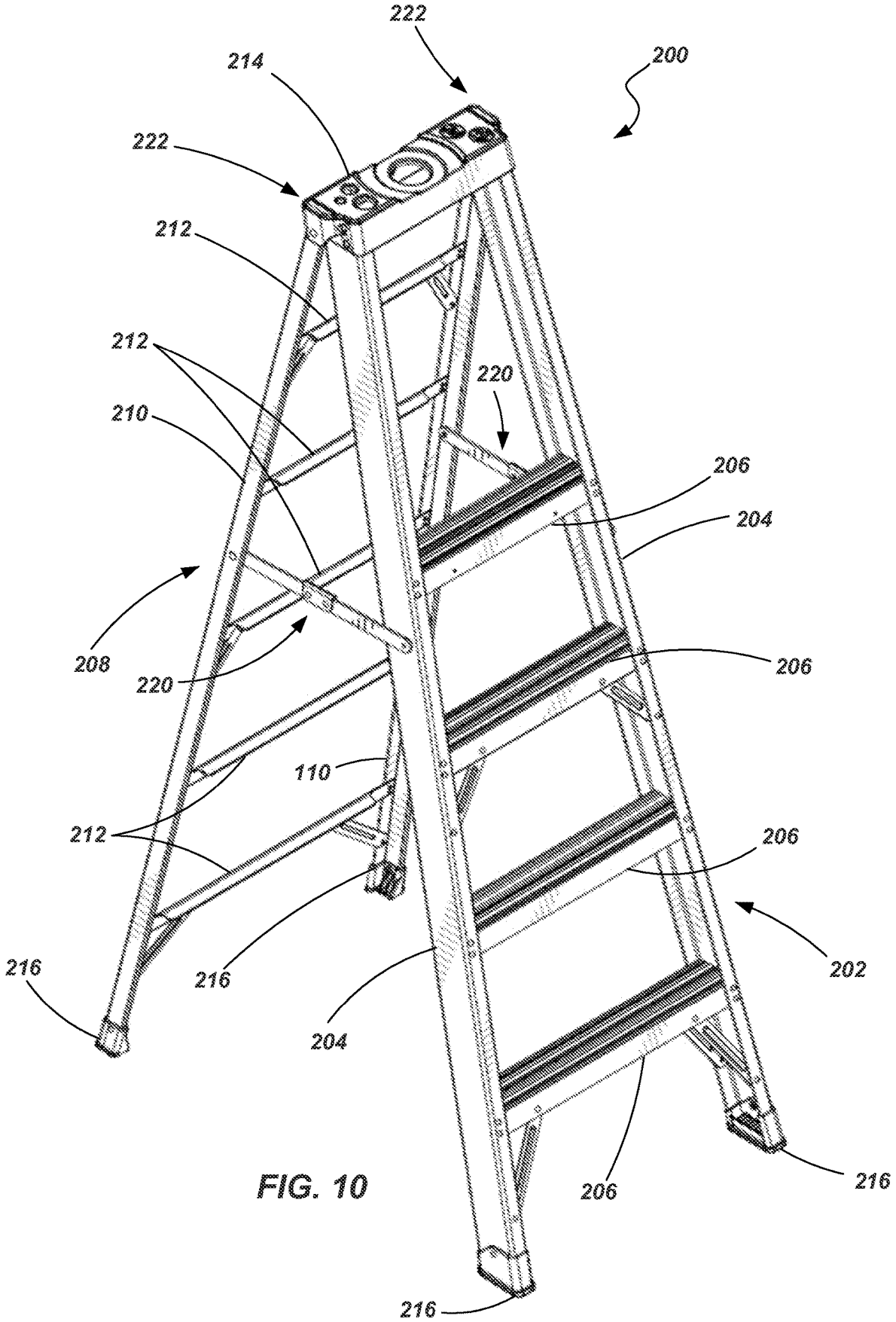
FIGS. 10 and 11 are perspective and side views, respectively, of a step ladder according to an embodiment of the present invention.
Figure 11:
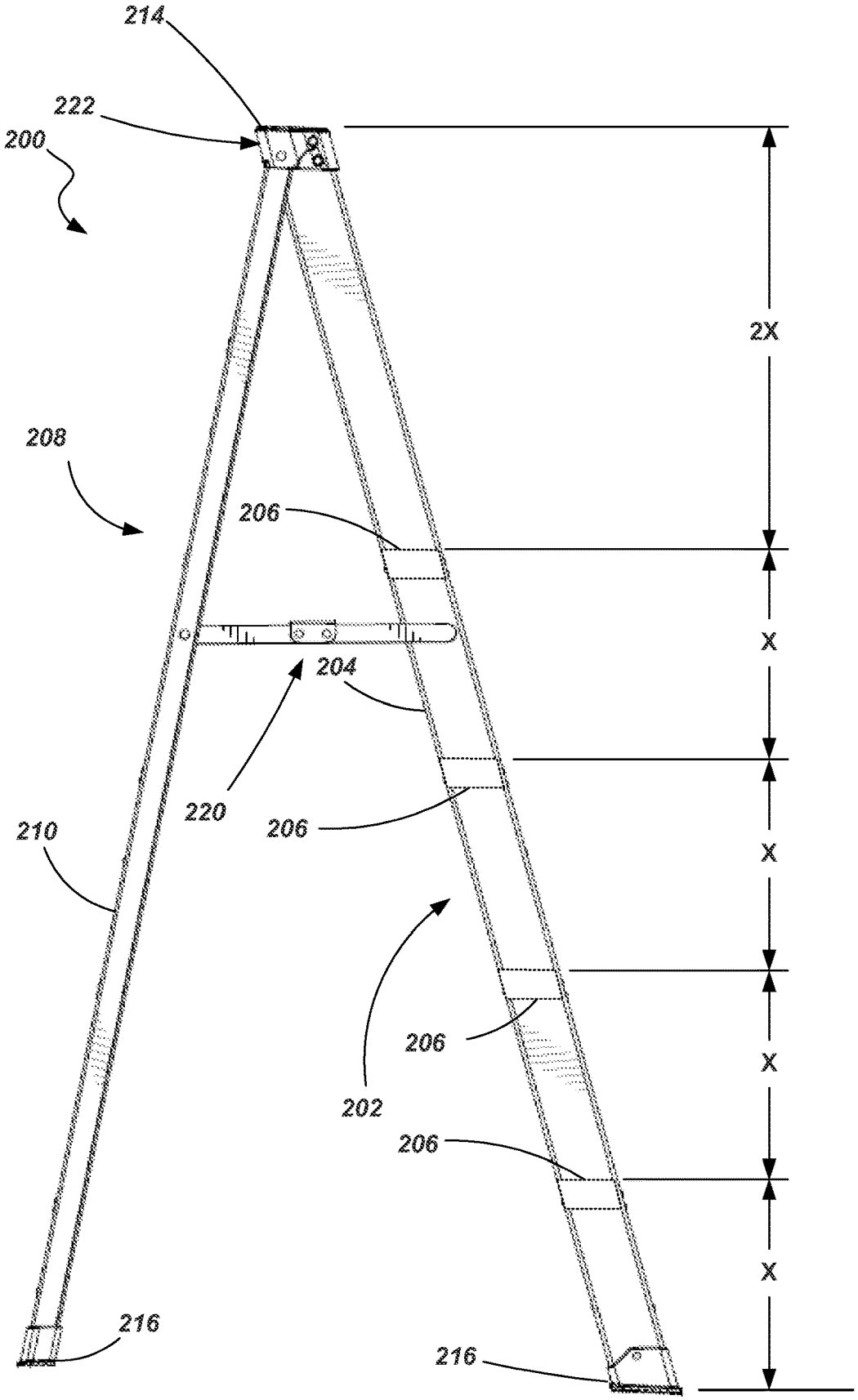

Referring now to FIGS. 10 and 11, a step ladder 200 is shown in accordance with another embodiment of the invention. The stepladder 200 includes a first assembly 202 having a pair of spaced apart rails 204 and a plurality of rungs 206 extending between, and coupled to, the rails 204. The spaced apart rungs 206 are substantially parallel to one another and are configured to be substantially level when the stepladder 200 is in an orientation for intended use so that the rungs 206 may be used as "steps" for a user to ascend the stepladder 200. In various embodiments, the upper surface of the rungs 206 may include traction features (e.g., grooves and ridges, grip tape or other anti-slip features) to provide a traction to a user while standing on the rungs 206.

The stepladder 200 also includes a second assembly 208 having a pair of spaced apart rails 210. In the embodiment shown, a plurality of cross-braces 212 extend between, and are coupled to, the spaced apart rails 210. The cross-braces 212 provide a desired level of strength and rigidity to the second assembly 208, but they are not configured as rungs (i.e., they are not intended to support a user). Additionally, while not specifically numbered in the drawings, it is noted that the ladder may include various bracing and support members (e.g., between rails and rungs) to help provide desired strength and stability.

A top cap 214 is coupled to a portion of the first assembly 202 and a portion of the second assembly 208. For example, the top cap 214 may be fixedly coupled with the upper end of each rail 204 of the first assembly 202 while being pivotally coupled to an upper end of each rail 210 of the second assembly 208 along a common axis.

The step ladder 200 may additionally include a plurality of feet 216 (one associated with each rail) configured to engage a supporting surface such as the ground. The feet 216 may be configured in a variety of manners based on, for example, the type of environment in which the ladder is anticipated to be used.

A pair of spreaders 220 (also referred to as hinged braces), are used to maintain a desired angle between the first and second assemblies 202 and 208 when the stepladder 200 is in a deployed or useable state. The hinged nature of such spreaders 220 helps to enable the first and second assemblies 202 and 208 to collapse into a stored state and then help lock the assemblies 202 and 208 in position relative to one another when in a deployed or useable state. As previously noted, the spreaders 220 are not configured as rungs or platforms, or otherwise configured to support a user standing thereon. Rather, the spreaders 220 are simply configured to structurally maintain the ladder 200 in a deployed position while enabling the rail assemblies 202 and 208 to be selectively collapsed relative to each other for storage and transportation of the ladder 200.

As with previously described embodiments, the various components of the first and second assemblies 202 and 208, the top cap 214, the feet 216 and the spreaders 220 may be formed of a variety of materials and using a variety of manufacturing techniques as will be appreciated by those of ordinary skill in the art.

The ladder 200 exhibits rung spacing similar to that which has been described above with respect to other embodiments. For example, the plurality of rungs 206 are spaced evenly apart (e.g., a vertical spacing of "X"), the upper surface of the lowermost rung being a similar vertical distance of "X" above the supporting structure or ground, and the upper surface of the uppermost rung being spaced a greater distance (e.g., a vertical spacing of "2X") from the upper surface of the top cap 214. Again, as with other embodiments, fewer or more rungs may be employed and the actual height of the ladder 200 may vary accordingly.

Figure 12:
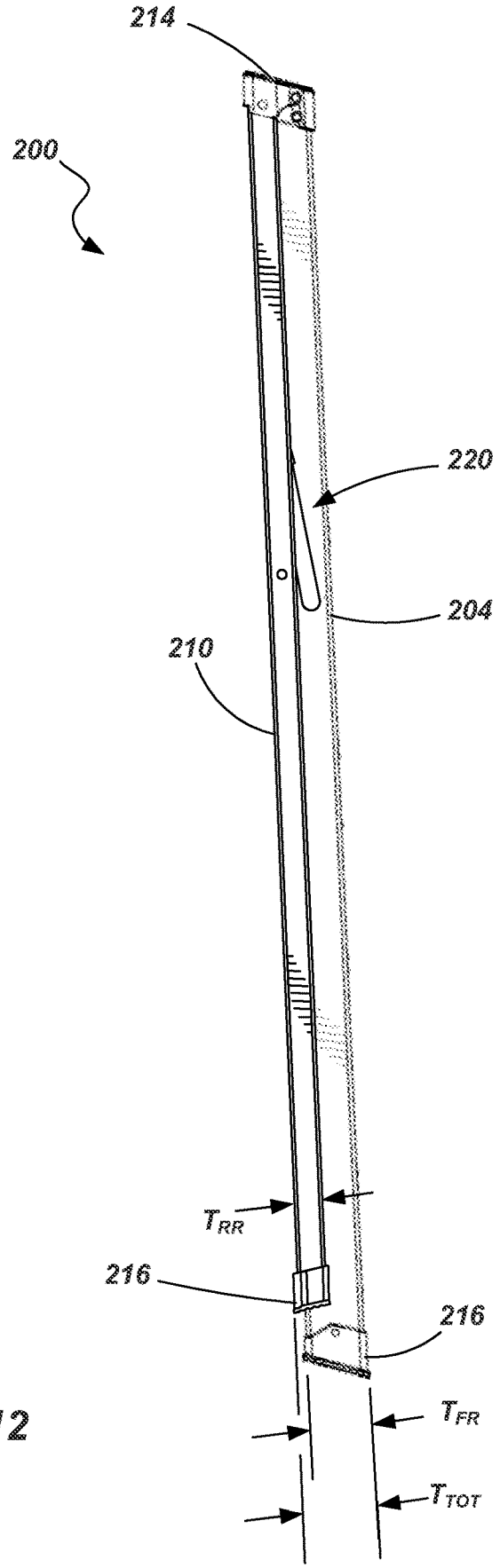
FIG. 12 is a side view of the step ladder shown in FIGS. 9 and 10 in a closed state.

Additionally, the top cap 214 of the ladder 200 is configured so that the rails 210 of the second assembly 208, which are pivotally coupled to the top cap 214, are spaced slightly wider than the rails 204 of the first assembly 202. In one embodiment, the laterally inner surfaces of the rails 210 of the second assembly 208 may exhibit approximately the same width as the laterally outer surfaces of the rails 204 of the first assembly 202 (i.e., they may be only slightly wider so as to avoid interference with the rails 204 of the first assembly 202 when pivoting between the deployed and stored states). To accommodate this difference in width, the top cap 214 may include laterally flared portions 222 to which the rails 210 of the second assembly 208 are attached. Such a configuration enables the ladder 200 to collapse into a stored state (by pivoting the second assembly 208 relative to the top cap 214) such that the two assemblies 202 and 208 fold into a thin profile, with the rear surface of the rails 210 of the second assembly 208 substantially aligning with or becoming nearly coplanar with the rear surface of the rails 204 of the first assembly 202 such as shown in FIG. 12. Stated another way, the overall depth or thickness $T_{TOT}$ of the ladder 200 when in a stored state is less than the sum of the depth or thickness $T_{FR}$ of the front rails (rails 204 of the first assembly 202) and the depth or thickness $T_{RR}$ of the rear rails (rails 210 of the second assembly 208)—i.e., $T_{TOT}<T_{FR}+T_{RR}$. In one particular embodiment, $T_{TOT}$ may be approximately equal to $T_{FR}$ or it may be some minor multiple of $T_{FR}$ (e.g., $T_{TOT}=1.1\times T_{FR}$; $T_{TOT}=1.25\times T_{FR}$; or $T_{TOT}=1.5\times T_{FR}$).

Other embodiments may also be used to provide a thin profile of the ladder when in a stored state including embodiments where both sets of rails are pivotally coupled with the top cap. Examples of such embodiments are described in U.S. Pat. No. 8,701,831, entitled STEPLADDERS AND RELATED METHODS, filed Mar. 2, 2010, the disclosure of which is incorporated by reference herein in its entirety.

In other embodiments, other types of step ladders may be configured with the rung spacing described herein. For example, an adjustable step ladder, wherein the first and second assemblies are height adjustable, may incorporate such rung spacing. An example of an adjustable step ladder is set forth in U.S. Pat. No. 8,186,481 previously incorporated by reference. Additionally, in some embodiments, the second assembly (e.g., 108) may include only a single rail, rather than a pair of spaced apart rails, if desired. Of course, the specific embodiments described herein are merely examples and a variety of step ladder configurations may be used in conjunction with the present invention.

In yet other embodiments, the ladder may include leveling or stabilizing features. For example, the feet of the ladder may be coupled with leveler mechanisms that enable the ladder to be deployed in an upright, level manner while the support surface (e.g., the ground) is sloping, stepped or otherwise exhibits some degree of elevation change. Some examples of a leveling mechanisms that may be used with the ladder are described in U.S. patent application Ser. No. 14,479,035, entitled ADJUSTABLE LADDERS, LADDER COMPONENTS AND RELATED METHODS, filed Sep. 5, 2014, the disclosure of which is incorporated by reference herein in its entirety.

While the invention may be susceptible to various modifications and alternative forms, specific embodiments have been shown by way of example in the drawings and have been described in detail herein. However, it should be understood that the invention is not intended to be limited to the particular forms disclosed. Additionally, features of one embodiment may be combined with features of other embodiments without limitation. The invention includes all modifications, equivalents, and alternatives falling within the spirit and scope of the invention as defined by the following appended claims.

What is claimed is:

1. A step ladder comprising:

a first assembly comprising:

a first pair of spaced apart rails;

a plurality of rungs extending between and coupled to the first pair of spaced apart rails;

a second assembly comprising a second pair of spaced apart rails;

a top cap having a front wall and a pair of side walls, the front wall extending between and integrally formed with the pair of side walls, wherein an upper portion of a laterally outer surface of each side wall of the pair of side walls includes a first portion adjacent the front wall and a second, laterally flared portion such that a first width is exhibited between laterally outermost surfaces of the first portions and a second width is exhibited between laterally outermost surfaces of the second, laterally flared portions, the second width being greater than the first width;

wherein each rail of the first pair of rails is fixedly coupled with a first portion of an associated one of the pair of side walls;

wherein each rail of the second pair of rails is pivotally coupled with an associated one of the flared portions of the side walls; and wherein the plurality of rungs exhibit a spacing with a first distance between adjacent rungs of the plurality of rungs and a second distance between the top cap and a rung of the plurality of rungs closest to the top cap, wherein the second distance is at least approximately twice the first distance.

2. The step ladder of claim 1, wherein, when the ladder is in a deployed condition and placed on a support surface, an upper surface of a lowermost rung of the plurality of rungs exhibits a spacing from the support surface that is equal to the first distance.

3. The step ladder of claim 1, wherein the first assembly further comprises a pair of feet, including one foot coupled to each of the first pair of spaced apart rails, wherein an upper surface of a rung of the plurality of rungs that is closest to the pair of feet exhibits a spacing from the pair of feet that is equal to the first distance.

4. The step ladder of claim 1, further comprising a plurality of cross-braces, each cross-brace of the plurality of cross-braces having a first end positioned adjacent to and coupled with a first rail of the second pair of rails and a second end positioned adjacent to and coupled with a second rail of the second pair of rails.

5. The step ladder of claim 1, further comprising at least two hinged spreader mechanisms, each spreader mechanism extending between the first assembly and the second assembly and having a first end coupled with one of the first pair of rails and a second end coupled with one of the second pair of rails.

6. The step ladder of claim 1, wherein the front wall is positioned closest to the first pair of rails and includes an exterior, undulating portion defining two, spaced apart concave surfaces between the pair of side walls.

7. The step ladder of claim 1, wherein a total number of rungs of the plurality of rungs is equal to a height of the ladder in feet minus the integer 2.

8. The step ladder of claim 1, wherein the first distance is approximately 1 foot and the second distance is approximately 2 feet.

9. The step ladder of claim 1, wherein an overall thickness ($T_{TOT}$) of the ladder when in a folded state is less than a sum of a thickness of the first pair of rails ($T_{FR}$) and a thickness of the second pair of rails ($T_{RR}$).

10. The step ladder of claim 9, wherein $T_{TOT}$ is approximately equal to $T_{FR}$.

11. The step ladder of claim 9, wherein $T_{TOT}$ is approximately $1.5 \times T_{FR}$ or less.

12. The step ladder of claim 1, wherein the rung of the plurality of rungs that is closest to the top cap exhibits a depth that is greater than a depth of the pair of rails of the first assembly.

* * * * *